US008307519B2

(12) United States Patent
Drew et al.

(10) Patent No.: US 8,307,519 B2
(45) Date of Patent: Nov. 13, 2012

(54) MEMORIALIZATION CASKET

(75) Inventors: Travis Edward Drew, Batesville, IN (US); Christopher M. Wessel, Metamora, IN (US)

(73) Assignee: Batesville Services, Inc., Batesville, IN (US)

( * ) Notice: Subject to any disclaimer, the term of this patent is extended or adjusted under 35 U.S.C. 154(b) by 308 days.

(21) Appl. No.: 12/564,620

(22) Filed: Sep. 22, 2009

(65) Prior Publication Data

US 2011/0067212 A1 Mar. 24, 2011

(51) Int. Cl.
*A61G 17/00* (2006.01)

(52) U.S. Cl. ..... 27/19; 27/14; 40/606.03; 40/725

(58) Field of Classification Search ..... 27/19, 2, 27/14; 29/428; 40/722, 724, 725, 790, 606.03
See application file for complete search history.

(56) References Cited

U.S. PATENT DOCUMENTS 3,157,936 A * 11/1964 Hillenbrand ..... 27/19
3,162,923 A * 12/1964 Kaeser ..... 27/19
3,395,431 A * 8/1968 Carson, Jr. ..... 27/19
4,357,741 A * 11/1982 Winburn et al. ..... 27/19
4,457,054 A 7/1984 Craft et al.
5,495,648 A * 3/1996 Rojdev et al. ..... 27/19
5,611,124 A 3/1997 Biondo et al.
5,675,877 A * 10/1997 Lewis ..... 27/19
6,237,202 B1 5/2001 Agee et al.
6,446,315 B2 9/2002 Agee et al.
6,715,190 B2 4/2004 Groemminger et al.
6,742,231 B1 * 6/2004 Calhoun et al. ..... 27/19
7,159,287 B2 * 1/2007 Parker et al. ..... 27/19
7,401,391 B2 * 7/2008 Maple et al. ..... 27/19
7,657,981 B2 * 2/2010 Parker ..... 27/19
2005/0150091 A1 * 7/2005 Parker et al. ..... 27/19

* cited by examiner

*Primary Examiner* — William L. Miller
(74) *Attorney, Agent, or Firm* — Wood, Herron & Evans, LLP

(57) ABSTRACT

A casket having provision for displaying a photograph, the photograph having a pair of opposite side edges, comprises a casket shell adapted to receive the remains of a deceased and having a pair of side walls, a pair of end walls, and a bottom wall, a casket cap closable on the casket shell, the cap including a dish assembly mounted to an underside thereof, the dish assembly including a cap panel, the cap panel including at least one pair of opposed retention members sized and configured to receive and retain the pair of opposite side edges of the photograph for display of the photograph when the cap is in an open position.

37 Claims, 5 Drawing Sheets

MEMORIALIZATION CASKET

RELATED APPLICATIONS

None.

FIELD

The subject matter herein relates generally to caskets and more particularly to caskets having memorialization features.

BACKGROUND

There is a trend in the death care industry towards "personalization"—the personalizing of funeral products and funeral, memorial or other services purchased for the deceased, to provide a more meaningful experience for the family and friends of the deceased. Oftentimes, there is a desire on the part of the deceased's family and loved ones to memorialize the faithfully departed. This may manifest itself in several ways such as, for example, displaying various religious or sentimental items close to or on the casket during viewing of the deceased or even placing items in the casket prior to interment of the casket above or below ground. The display and/or storage of various items of personalty near or in caskets has existed as a means to memorialize the deceased.

One of the earlier attempts at providing a means of personalizing or customizing a casket to the deceased may be seen with reference to the assignee's U.S. Pat. No. 4,457,054 titled Casket Shelf. This patent discloses a casket shelf which is mounted to the dish assembly of the head end cap when the head end cap is in the open position, such as during viewing of the deceased. The shelf provides a surface for supporting and displaying articles of religious or personal significance to the deceased.

A more recent innovation may be seen with reference to the assignee's U.S. Pat. No. 5,611,124 titled Casket Having Memorabilia Compartment. Caskets embodying one embodiment of the invention of the '124 patent have a drawer built into the foot end lid in which keepsakes of the deceased can be stored and displayed, and are commercially available as the MemorySafe® line of caskets from Batesville®. Until the innovative casket of the '124 patent, caskets did not have any designated, easily accessible receptacle or compartment for either the display of personal effects of the deceased therein or the inclusion therein of mementos of memorialization by the deceased's family and friends. Prior attempts at solving this shortcoming had generally taken the form of the placement of a small memento box into the casket alongside the deceased. However, such memento boxes often appeared as an afterthought, simply placed alongside the deceased in the casket somewhat haphazardly. The '124 patent solved this shortcoming, as it provided the first casket with a memorabilia compartment integral to the casket for displaying and storing mementos and other items of memorabilia.

A further, and even more recent, innovation in the area of casket personalization may be seen with reference to the assignee's U.S. Pat. No. 6,715,190 for Memorialization Casket. This patent discloses an alcove structure formed in the cap panel in the underside of the head end lid, for receiving ornaments or memorabilia when the lid is in the open position during visitation or during a funeral or other memorial service, as a means of memorializing the deceased.

Yet another recent innovation in the area of casket personalization may be seen with reference to the assignee's U.S. Pat. Nos. 6,237,202 and 6,446,315. These patents disclose a dish assembly, mounted to the casket cap, including a cap panel having an opening that accepts a cap panel insert that is removably received in the cap panel opening. The cap panel insert can be personalized to the deceased. The cap panel insert can be removed from the cap subsequent to a memorial service for the deceased and retained by the loved one of the deceased as a memorial to the deceased.

Despite the advancements made in the area of personalization of caskets as demonstrated by the products discussed above, there remains room for improvement.

SUMMARY

In one aspect, a casket having provision for displaying a photograph, the photograph having a pair of opposite side edges, comprises a casket shell adapted to receive the remains of a deceased and having a pair of side walls, a pair of end walls, and a bottom wall, a casket cap closable on the casket shell, the cap including a dish assembly mounted to an underside thereof, the dish assembly including a cap panel, the cap panel including at least one pair of opposed retention members sized and configured to receive and retain the pair of opposite side edges of the photograph for display of the photograph when the cap is in an open position.

The casket can include first, second, and third pairs of opposed retention members. The first pair of opposed retention members can have a first spacing therebetween, the second pair of opposed retention members can have a second spacing therebetween, and the third pair of opposed retention members can have a third spacing therebetween, the second spacing being greater than the first spacing, the third spacing being greater than the second spacing. The first spacing can be such as to retain a 4"×6" photograph oriented horizontally, the second spacing can be such as to retain a 5"×7" photograph oriented vertically, and the third spacing can be such as to retain a 8"×10" photograph oriented vertically.

The cap panel can comprise a cardboard cap panel board, and a pair of chipboard pleat boards attached to the cap panel board, each of the pair of pleat boards being accordion folded so as to produce three pleats upon being attached to the cap panel board. The cap panel board can be covered with fabric and each of the pair of pleat boards can be covered with fabric. The fabric can be adhesively secured to the pleat boards prior to the pleat boards being accordion folded. The pleat boards can have opposite side edges which can be stapled to the cap panel board.

In another aspect, a casket having provision for displaying a photograph, the photograph having a pair of opposite side edges, comprises a casket shell adapted to receive the remains of a deceased and having a pair of side walls, a pair of end walls, and a bottom wall, a casket cap closable on the casket shell, the cap including a dish assembly mounted to an underside thereof, the dish assembly including a cap panel, the cap panel including a cap panel board and a pair of opposed pleat boards attached to the cap panel board, the pair of pleat boards sized and configured to receive and retain the pair of opposite side edges of the photograph for display of the photograph when the cap is in an open position.

In yet another aspect, a casket having provision for displaying a photograph, the photograph having a pair of opposite side edges, comprises a casket shell adapted to receive the remains of a deceased and having a pair of side walls, a pair of end walls, and a bottom wall, a casket cap closable on the casket shell, the cap including a dish assembly mounted to an underside thereof, the dish assembly including a cap panel, the cap panel including a cap panel board and a pair of opposed retention strips attached to the cap panel board, the pair of retention strips sized and spaced to receive and retain the pair of opposite side edges of the photograph for display of the photograph when the cap is in an open position.

In a further aspect, a method of making a dish assembly for a casket comprises the steps of providing a cap panel board, providing a pair of pleat boards, accordion folding each of the pleat boards, and attaching the accordion folded pleat boards to the cap panel board.

The method can further comprise the steps of covering the cap panel board with fabric, covering each of the pair of pleat boards with fabric prior to accordion folding the pleat boards, and attaching opposite side edges of the accordion folded pleat boards to the cap panel board.

In a yet further aspect a method of making a casket is provided.

DRAWINGS

DESCRIPTION

Figure 1:
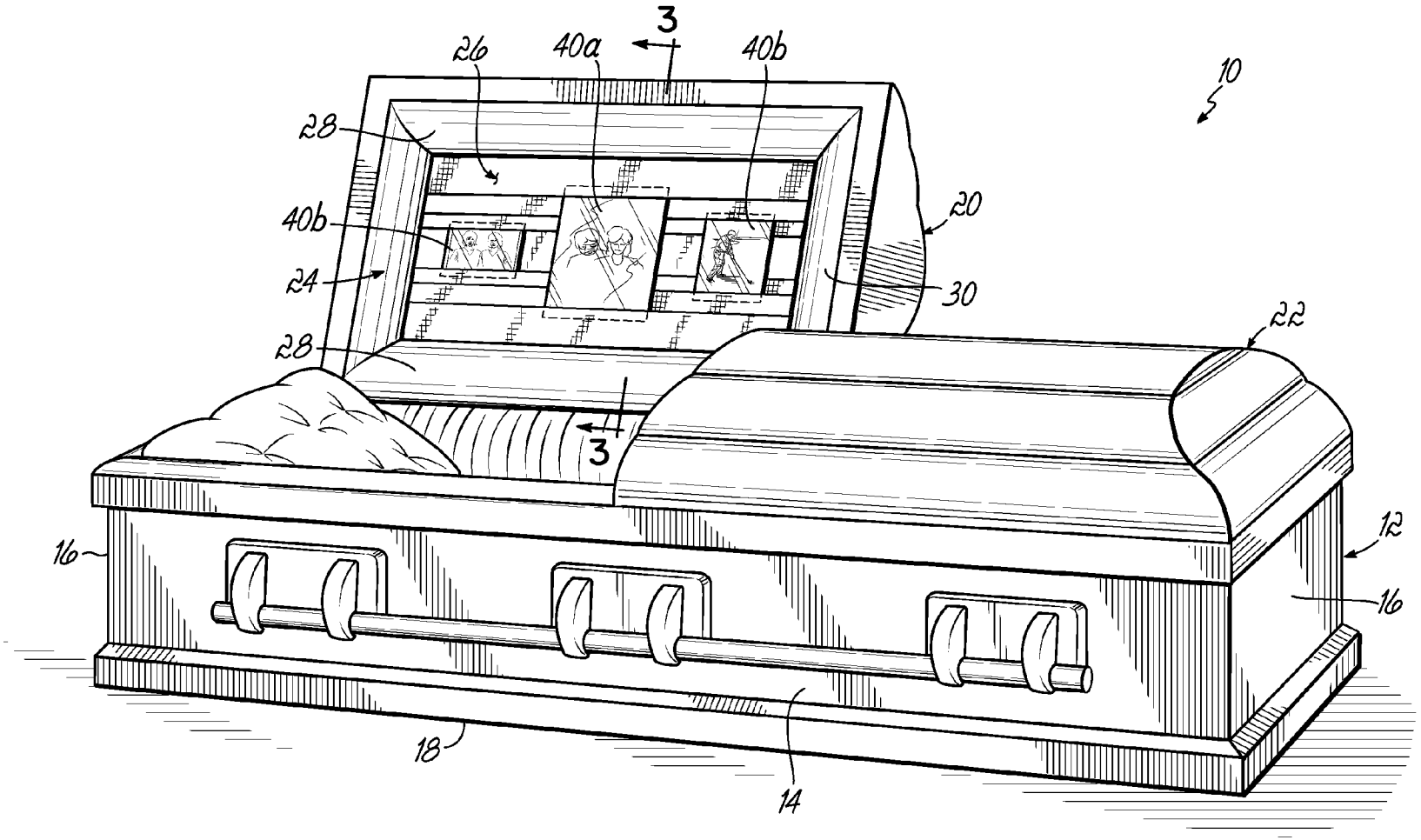
FIG. 1 is a perspective view of our casket.
Figure 3:
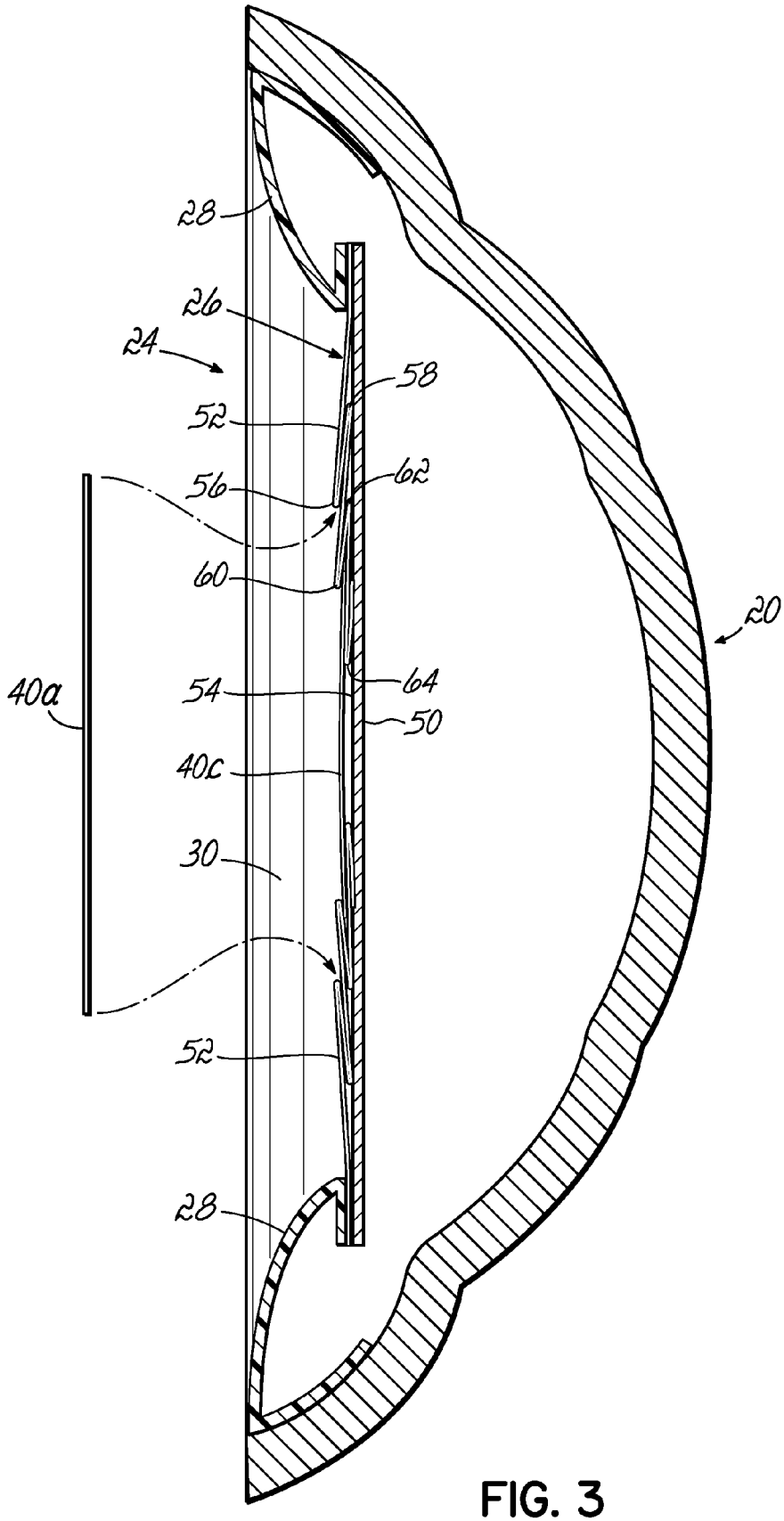
FIG. 3 is a cross-sectional view taken along line 3-3 in FIG. 1.

Referring to FIGS. 1 and 3, a casket 10 has a shell 12 adapted to receive the remains of a deceased having a pair of side walls 14, 14, a pair of end walls 16, 16, and a bottom wall 18, and a cap 20 closable on the shell 12. The casket may have a pair of caps (head end cap 20 and foot end cap 22 as illustrated) or a single cap the full length of the casket. Cap 20 has an ornamental dish assembly 24 mounted to an underside of the cap 20.

The dish assembly 24 includes a cap panel 26, a pair of opposed puffings 28, 28 attached to the long sides of the cap panel 26 and a pair of opposed puffings 30, 30 attached to the shorts sides of the cap panel 26. Puffing 28, 28 and 30, 30 are attached to the cap panel 26 by means known to those skilled in the art, for example staples, adhesives, etc. The dish assembly 24 is mounted and retained in the underside of the cap 20 by means known to those skilled in the art as well.

Figure 2A:
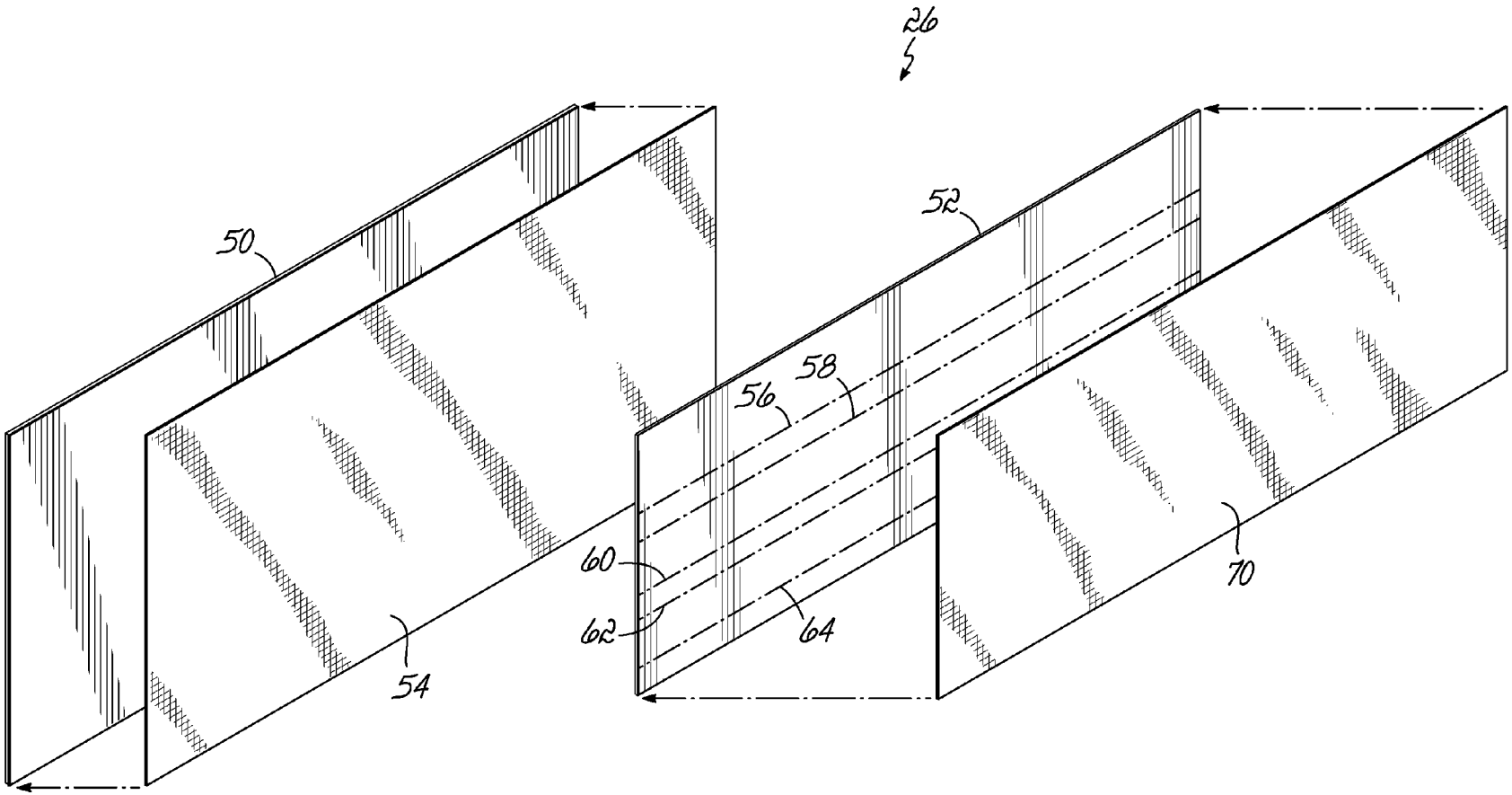
FIGS. 2A-2C are perspective views of the cap panel of the casket of FIG. 1 being assembled.
Figure 2C:
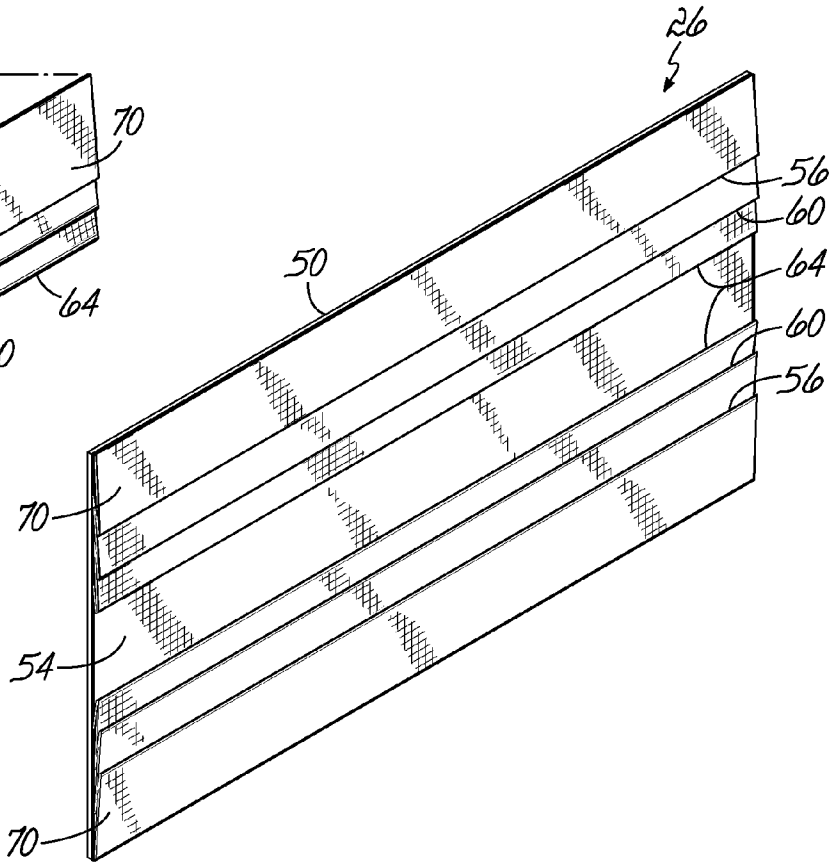
Figure 4:
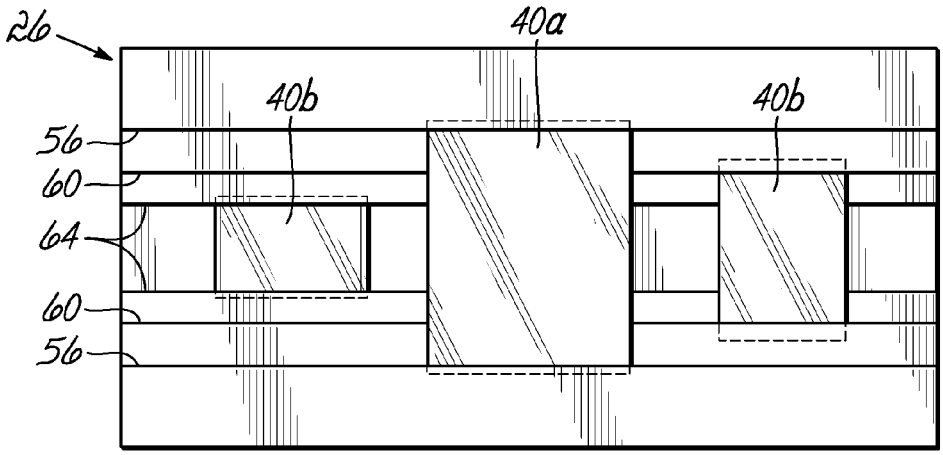
FIGS. 4-6 are front views of the cap panel of FIGS. 1-3 illustrating various photograph layouts displayed.
Figure 5:
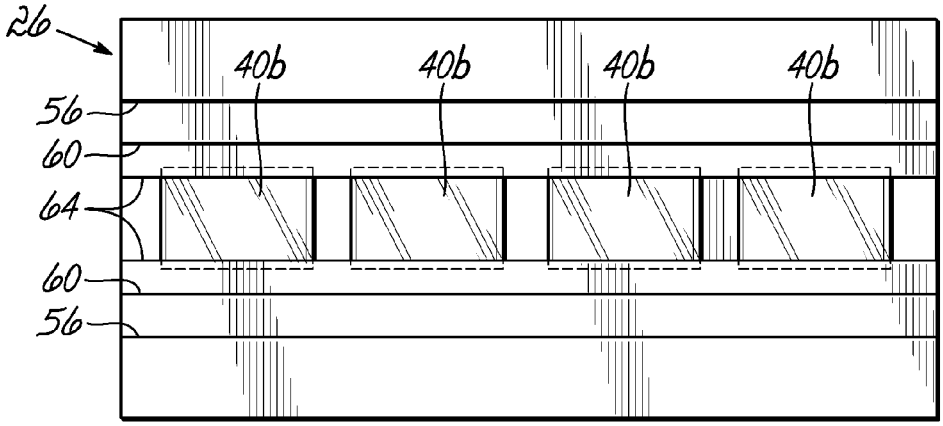
Figure 6:
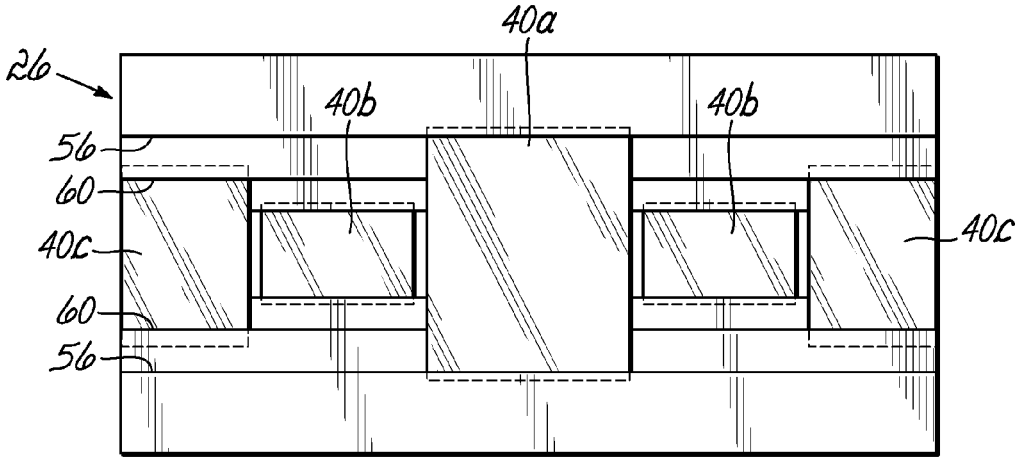

Referring to FIGS. 1-2C, the cap panel 26 includes a means for conveniently displaying one or more photographs to, for example, memorialize the deceased during a memorial or other service. The cap panel 26 includes at least one pair of opposed retention members sized and configured or otherwise adapted to receive and retain the pair of opposite sided edges of the photograph for display of the photograph when the cap 20 is in the open position. The opposed retention members can take the form of, for example, opposed retention strips or retention pleats. In the illustrated embodiment, the cap panel is equipped to display three sizes of photographs, 4"×6", 5"×7", and 8"×10". The cap panel 26 could be outfitted to display only a single size of photograph or multiple sizes of photographs. For example, FIGS. 1 and 4 illustrate a single 8"×10" photograph 40*a* and a pair of 4"×6" photographs 40*b* being displayed, FIG. 5 illustrates four 4"×6" photographs 40*b* being displayed, and FIG. 6 illustrates a single 8"×10" photograph 40*a*, a pair of 4"×6" photographs 40*b*, and a pair of 5"×7" photographs 40*c* being displayed. The invention is not limited, however, as to any particular photograph size or number of photographs.

Referring to FIGS. 2A-3 one construction that can be utilized to produce a cap panel with a means for conveniently displaying one or more photographs is illustrated. Cap panel 26 can include a cap panel board 50 fabricated of a substantially rigid material, for example, cardboard. Cap panel 26 can also include a pair of pleat boards 52, 52 fabricated of a semi-rigid material, for example, chipboard. (Puffings 28, 28 and 30, 30 can also be fabricated of a semi-rigid material such as chipboard.) Cap panel board 50 can be covered with decorative fabric 54. Fabric 54 can be attached to cap panel board 50 with adhesives, staples, etc. Alternatively, cap panel board 50 can be "flocked" to provide it with a decorative fabric like appearance. Pleat boards 52 can include score lines, for example five score lines 56, 58, 60, 62, and 64. Pleat boards 52 can also be covered with decorative fabric 70, which can be attached to pleat boards 52 by adhesives, staples, etc. Alternatively, pleat boards 52 can be flocked to provide them with a decorative fabric like appearance. (Puffings 28, 28 and 30, 30 can also be either covered with a decorative fabric or flocked.)

Figure 2B:
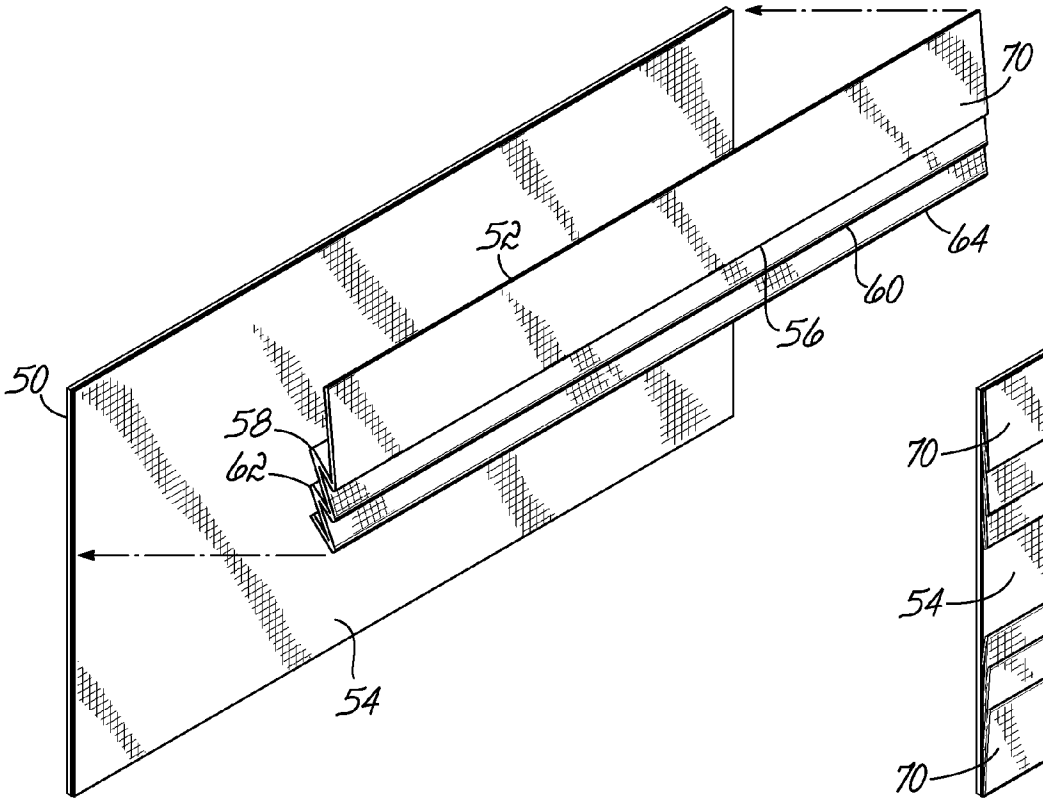

After decorative fabric 70 is attached to pleat boards 52, the pleat boards 52 are accordion folded on the five score lines 56, 58, 60, 62, 64 as shown in FIG. 2B. Then the pleat boards 52 can be attached to the cap panel board 50 with adhesives, staples, etc. See FIGS. 2C and 3. Once attached to the cap panel board 50 each pleat board 52 forms three pleats 52*a*, 52*b*, 52*c*. Since the pleat boards 52 are accordion folded, once attached to the cap panel board 50 each pleat 52*a*, 52*b*, 52*c* forms a corresponding pleat pocket. The resulting pleat pockets are not necessarily required, however, and more-or-less result from a convenient manner of forming the opposed photograph retention strips which are the pleats by accordion folding the pleat boards 52. The spacings between the five score lines 56, 58, 60, 62, and 64, and the spacing between the two pleat boards 52, 52, are chosen so that essentially just the edges of 4"×6", 5"×7", and 8"×10" photographs are retained by a respective pair of the pleats. Other score line spacings and pleat board spacings can of course be chosen as desired or required.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. Accordingly, the scope of the right to exclude shall be limited only by the following claims and their equivalents.

What is claimed is:

1. A casket having provision for displaying a photograph, the photograph having a pair of opposite generally horizontally oriented upper and lower side edges, said casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a pair of opposed puffings attached to opposed longer sides of said cap panel and a pair of opposed puffings attached to opposed shorter sides of said cap panel, said cap panel including at least one pair of opposed retention members attached thereto, said retention members being generally horizontally oriented when said cap is in an open position, said retention members configured so as to overlie at least a portion of a front face of said cap panel subsequent to final assembly of said cap panel to said dish assembly, said retention members sized and configured to receive and retain the pair of opposite generally horizontally oriented upper and lower side edges of the photograph underneath said retention members for display of the photograph when said cap is in the open position.

2. A casket having provision for displaying a photograph, the photograph having a pair of opposite generally horizontally oriented upper and lower side edges, said casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a pair of opposed puffings attached to opposed longer sides of said cap panel and a pair of opposed puffings attached to opposed shorter sides of said cap panel, said cap panel including at least one pair of opposed retention members attached thereto, said retention members being generally horizontally oriented when said cap is in an open position, said retention members sized and configured to receive and retain the pair of opposite generally horizontally oriented upper and lower side edges of the photograph for display of the photograph when said cap is in the open position, said cap panel including first, second, and third pairs of said opposed retention members, said first pair of opposed retention members having a first spacing therebetween, said second pair of opposed retention members having a second spacing therebetween, said third pair of opposed retention members having a third spacing therebetween, said second spacing being greater than said first spacing, said third spacing being greater than said second spacing.

3. The casket of claim 2 wherein said first spacing is such as to retain a 4"×6" photograph oriented horizontally, said second spacing is such as to retain a 5"×7" photograph oriented vertically, and said third spacing is such as to retain a 8"×10" photograph oriented vertically.

4. The casket of claim 3 wherein said cap panel comprises a cardboard cap panel board, said retention members comprising a pair of chipboard pleat boards attached to said cap panel board, each of said pair of pleat boards being accordion folded so as to produce three pleats upon being attached to said cap panel board.

5. The casket of claim 4 wherein said cap panel board is covered with fabric and each of said pair of pleat boards is covered with fabric.

6. The casket of claim 5 wherein said fabric is adhesively secured to said pleat boards prior to said pleat boards being accordion folded.

7. The casket of claim 6 wherein said pleat boards have opposite side edges stapled to said cap panel board.

8. The casket of claim 3 wherein said cap panel comprises:

a substantially rigid cap panel board, a pair of semi rigid pleat boards attached to said cap panel board, each of said pair of pleat boards being accordion folded so as to produce three pleats upon being attached to said cap panel board.

9. The casket of claim 8 wherein said cap panel board is flocked and each of said pair of pleat boards is flocked.

10. The casket of claim 9 wherein said pair of pleat boards are flocked prior to said pleat boards being accordion folded.

11. A casket having provision for displaying a photograph, the photograph having a pair of opposite generally horizontally oriented upper and lower side edges, said casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a pair of opposed puffings attached to opposed longer sides of said cap panel and a pair of opposed puffings attached to opposed shorter sides of said cap panel, said cap panel including a cap panel board and a pair of opposed pleat boards each including at least one pleat, said pair of pleat boards attached to said cap panel board and being generally horizontally oriented when said cap is in an open position, said pair of pleat boards sized and configured to receive and retain the pair of opposite generally horizontally oriented upper and lower side edges of the photograph for display of the photograph when said cap is in the open position.

12. A casket having provision for displaying a photograph, the photograph having a pair of opposite generally horizontally oriented upper and lower side edges, said casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a pair of opposed puffings attached to opposed longer sides of said cap panel and a pair of opposed puffings attached to opposed shorter sides of said cap panel, said cap panel including a cap panel board and a pair of opposed pleat boards attached to said cap panel board, said pair of pleat boards being generally horizontally oriented when said cap is in an open position, said pair of pleat boards sized and configured to receive and retain the pair of opposite generally horizontally oriented upper and lower side edges of the photograph for display of the photograph when said cap is in the open position, wherein each of said pair of pleat boards is accordion folded so as to produce three pleats upon being attached to said cap panel board.

13. The casket of claim 12 wherein corresponding ones of said pleats of said pair of pleat boards cooperate to form three retention members structured and arranged to retain a 4"×6" photograph oriented horizontally, a 5"×7" photograph oriented vertically, and a 8"×10" photograph oriented vertically.

14. The casket of claim 13 wherein said cap panel board is covered with fabric and each of said pair of pleat boards is covered with fabric.

15. The casket of claim 14 wherein said fabric is adhesively secured to said pleat boards prior to said pleat boards being accordion folded.

16. The casket of claim 15 wherein said pleat boards have opposite side edges stapled to said cap panel board.

17. A casket having provision for displaying a photograph, the photograph having a pair of opposite generally horizontally oriented upper and lower side edges, said casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a pair of opposed puffings attached to opposed longer sides of said cap panel and a pair of opposed puffings attached to opposed shorter sides of said cap panel, said cap panel including a cap panel board and at least one pair of opposed retention strips attached to said cap panel board and configured so as to overlie at least a portion of a front face of said cap panel board subsequent to final assembly of said cap panel to said dish assembly, said pair of retention strips being generally horizontally oriented when said cap is in an open position and sized and spaced to receive and retain the pair of opposite generally horizontally oriented upper and lower side edges of the photograph underneath said retention strips for display of the photograph when said cap is in the open position.

18. The casket of claim 17 wherein said cap panel board is covered with fabric and each of said at least one pair of retention strips is covered with fabric.

19. The casket of claim 17 wherein said retention strips extend substantially a transverse extent of said cap panel board.

20. A casket having provision for displaying a photograph, the photograph having a pair of opposite generally horizontally oriented upper and lower side edges, said casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a pair of opposed puffings attached to opposed longer sides of said cap panel and a pair of opposed puffings attached to opposed shorter sides of said cap panel, said cap panel including a cap panel board and at least one pair of opposed retention strips attached to said cap panel board, said pair of retention strips being generally horizontally oriented when said cap is in an open position and sized and spaced to receive and retain the pair of opposite generally horizontally oriented upper and lower side edges of the photograph for display of the photograph when said cap is in the open position, said cap panel including first and second pairs of said retention strips, said first pair of opposed retention strips having a first spacing therebetween, said second pair of opposed retention strips having a second spacing therebetween, said second spacing being greater than said first spacing.

21. The casket of claim 20 wherein said first spacing is such as to retain a 4"×6" photograph oriented horizontally, and said second spacing is such as to retain a 5"×7" photograph oriented vertically.

22. The casket of claim 20 wherein said first and second pairs of retention strips are formed from accordion folded first and second pleat boards which, when attached to said cap panel board, yield two pleats per pleat board.

23. A casket having provision for displaying a photograph, the photograph having a pair of opposite generally horizontally oriented upper and lower side edges, said casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a pair of opposed puffings attached to opposed longer sides of said cap panel and a pair of opposed puffings attached to opposed shorter sides of said cap panel, said cap panel including a cap panel board and at least one pair of opposed retention strips attached to said cap panel board, said pair of retention strips being generally horizontally oriented when said cap is in an open position and sized and spaced to receive and retain the pair of opposite generally horizontally oriented upper and lower side edges of the photograph for display of the photograph when said cap is in the open position, said cap panel including first, second and third pairs of said retention strips, said first pair of opposed retention strips having a first spacing therebetween, said second pair of opposed retention strips having a second spacing therebetween, said third pair of opposed retention strips having a third spacing therebetween, said second spacing being greater than said first spacing, said third spacing being greater than said second spacing.

24. The casket of claim 23 wherein said first spacing is such as to retain a 4"×6" photograph oriented horizontally, said second spacing is such as to retain a 5"×7" photograph oriented vertically, and said third spacing is such as to retain a 8"×10" photograph oriented vertically.

25. The casket of claim 23 wherein said first, second, and third pairs of retention strips are formed from accordion folded first and second pleat boards which, when attached to said cap panel board, yield three pleats per pleat board.

26. A casket having provision for displaying a photograph, the photograph having a pair of opposite side edges, said casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, said cap panel including a cap panel board and at least one pair of opposed retention strips attached to said cap panel board, said pair of retention strips sized and spaced to receive and retain the pair of opposite side edges of the photograph for display of the photograph when said cap is in an open position, wherein said at least one pair of opposed retention strips are spaced apart by an amount so as to retain a 4"×6" photograph oriented horizontally.

27. A casket having provision for displaying a photograph, the photograph having a pair of opposite generally horizontally oriented upper and lower side edges, said casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a pair of opposed puffings attached to opposed longer sides of said cap panel and a pair of opposed puffings attached to opposed shorter sides of said cap panel, said cap panel including a cap panel board and at least one pair of opposed retention strips attached to said cap panel board, said pair of retention strips being generally horizontally oriented when said cap is in an open position and sized and spaced to receive and retain the pair of opposite generally horizontally oriented upper and lower side edges of the photograph for display of the photograph when said cap is in the open position, wherein said cap panel board is covered with fabric and each of said at least one pair of retention strips is covered with fabric, wherein said fabric is adhesively secured to said retention strips prior to said retention strips being accordion folded.

28. The casket of claim 27 wherein said retention strips are stapled to said cap panel board.

29. A method of making a dish assembly for installation in a casket lid comprising the steps of:

providing a cap panel board, providing a pair of pleat boards, accordion folding each of the pleat boards, and attaching the accordion folded pleat boards to the cap panel board so that the pleat boards are generally horizontally oriented when the dish assembly is installed in the casket lid and the casket lid is in an open position, attaching a puffing member to each side of the cap panel board, and installing the dish assembly in the casket lid.

30. The method of claim 29 further comprising the steps of:

covering the cap panel board with fabric, covering each of the pair of pleat boards with fabric prior to accordion folding the pleat boards, and attaching opposite side edges of the accordion folded pleat boards to the cap panel board.

31. The method of claim 29 further comprising the steps of:

flocking the cap panel board, flocking each of the pair of pleat boards prior to accordion folding the pleat boards, and attaching opposite side edges of the accordion folded pleat boards to the cap panel board.

32. A method of making a casket comprising the steps of:

providing a casket shell, providing a casket lid closable on the casket shell, making a dish assembly comprising the steps of:

providing a cap panel board, providing a pair of pleat boards, accordion folding each of the pleat boards, attaching the accordion folded pleat boards to the cap panel board so that the pleat boards are generally horizontally oriented when the dish assembly is installed in the casket lid and the casket lid is in an open position, attaching a puffing member to each side of the cap panel board, and installing the dish assembly in the casket lid.

33. The method of claim 32 further comprising the steps of:

covering the cap panel board with fabric, covering each of the pair of pleat boards with fabric prior to accordion folding the pleat boards, and attaching opposite side edges of the accordion folded pleat boards to the cap panel board.

34. The method of claim 32 further comprising the steps of:

flocking the cap panel board, flocking each of the pair of pleat boards prior to accordion folding the pleat boards, and attaching opposite side edges of the accordion folded pleat boards to the cap panel board.

35. A casket having provision for displaying a photograph, the photograph having a pair of opposite generally horizontally oriented upper and lower side edges, said casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a first pair of opposed puffings attached to opposed longer sides of said cap panel and a second pair of opposed puffings attached to opposed shorter sides of said cap panel, and a pair of opposed pleat members, each including at least one pleat, attached to said cap panel, said pair of pleat members being generally horizontally oriented when said cap is in an open position and sized and configured to receive and retain the pair of opposite generally horizontally oriented upper and lower side edges of the photograph for display of the photograph when said cap is in the open position.

36. The casket of claim 35 wherein said pair of opposed pleat members are pleat strips.

37. The casket of claim 35 wherein said pair of opposed pleat members are pleat boards.

* * * * *